US006990962B2

(12) United States Patent
Suzuki

(10) Patent No.: US 6,990,962 B2
(45) Date of Patent: Jan. 31, 2006

(54) EVAPORATIVE FUEL CONTROL SYSTEM FOR INTERNAL COMBUSTION ENGINE

(75) Inventor: Ryoji Suzuki, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 11/134,523

(22) Filed: May 20, 2005

(65) Prior Publication Data

US 2005/0257780 A1 Nov. 24, 2005

(30) Foreign Application Priority Data

May 24, 2004 (JP) ..... 2004-152905

(51) Int. Cl.
*F02M 33/02* (2006.01)

(52) U.S. Cl. ..... 123/519; 123/518

(58) Field of Classification Search ..... 123/518, 123/519, 520, 521, 198 D
See application file for complete search history.

(56) References Cited

U.S. PATENT DOCUMENTS 6,119,663 A 9/2000 Okuma
6,837,224 B2 * 1/2005 Kidokoro et al. ..... 123/520
6,892,712 B2 * 5/2005 Miwa et al. ..... 123/520

FOREIGN PATENT DOCUMENTS

JP 10-89162 A 4/1998
JP 3412678 B2 3/2003

* cited by examiner

*Primary Examiner*—Bibhu Mohanty

(74) *Attorney, Agent, or Firm*—Flynn, Thiel, Boutell & Tanis, P.C.

(57) ABSTRACT

An evaporative fuel control system for an internal combustion engine having a canister that absorbs evaporative fuel generated in the fuel tank. An atmosphere open passage connects the canister with the atmosphere. A purge valve is disposed between the intake passage and the canister. A purge controller controls the purge valve so that the evaporative fuel absorbed by the canister is purged and supplied to the intake passage. A leak check system examines leakage in the evaporative fuel control system by causing negative pressure in the evaporative fuel control system during stop of the engine. The leak check system includes a factory test mode which is provided with a decreased leak check time which is shorter than that for normal leak check when the evaporative fuel control system receives a factory test signal.

3 Claims, 5 Drawing Sheets

EVAPORATIVE FUEL CONTROL SYSTEM FOR INTERNAL COMBUSTION ENGINE

This application is 1 of 3 related, concurrently filed applications, all entitled "Evaporative Fuel Control System for Internal Combustion Engine", all having the same inventorship, and having application Ser. Nos. 11/134,524, 11/134,525, and 11/134,523, respectively. The disclosure of the related co-pending applications are herein incorporated by reference.

FIELD OF THE INVENTION

This invention relates to an evaporative fuel control system for an internal combustion engine, and more particularly to an evaporative fuel control system which examines leakage without reduction in a speed of an assembly line for checking the completed cars in factories.

BACKGROUND OF THE INVENTION

Traditional designs of internal combustion engines employ evaporative fuel control systems to control unwanted air pollution and loss of fuel due to evaporation of fuel from the tank, the carburetor, and other engine components. In particular, there is an evaporative fuel control system which employs a fuel vapor collection canister containing an adsorbent material, such as activated carbon, for adsorbing evaporative fuel, and a purge system for releasing the adsorbed fuel and supplying it to the engine during operation of the engine.

Conventional evaporative fuel control systems typically also include a leak check system employing different leak check methods to check for leakage of evaporative fuel (leak of vapor) to the atmosphere.

Conventional evaporative fuel control systems for an engine also exist wherein the systemchecks for evaporative fuel leaks after stop of the engine and refuel to a fuel tank. See JP No. 3412678.

Conventional evaporative fuel control systems for an engine also exist that provide a test mode which opens a purge passage between the fuel tank and an intake passage, and shuts an atmosphere open section, when the engine is in an idling state and a test signal is sent from a testing device to a control section. In this test mode, whether there is a failure in the evaporative fuel control system or not is determined based on a pressure variation of a purge passage toward the fuel tank over a predetermined time. See JP Laid-Open No. H10-89162.

One leak check method for an evaporative fuel control system for an engine utilizes an electric pressure reducing pump, a reference orifice, a pressure sensor, and a switching valve. In this leak check method, a reference pressure is primarily measured after the atmosphere is vacuumed by the pressure reducing pump through the reference orifice. A pressure is then measured after a certain time after the switching valve is switched such that the fuel tank is vacuumed. By comparing this pressure with the reference pressure, the occurrence of leakage (large leak greater than the reference orifice) is determined.

This leak check of the evaporative fuel control system is executed during normal operation of the vehicle (in fact during stop of the engine while stopping of the vehicle). It takes some time to conduct a leak check, since the pressure is measured while reducing the check passages of the system by the pressure reducing pump.

However, this increases the amount of time required to conduct a leak check in a checking process for completed cars in the factories, which may exceed an acceptable amount of process time required in assembly lines.

SUMMARY OF THE INVENTION

In order to obviate or at least minimize the above-described inconveniences, the present invention provides an evaporative fuel control system for an internal combustion engine. In this system, a canister is disposed on an evaporative fuel control passage connecting between an intake passage for the engine and a fuel tank to absorb the evaporative fuel generated in the fuel tank. Also, an atmosphere open passage connects the canister with the atmosphere. A purge valve is disposed between the intake passage and the canister. A purge controller controls the purge valve so that the evaporative fuel absorbed by the canister is purged and supplied to the intake passage. A leak check system examines leakage in the evaporative fuel control system by causing negative pressure in the evaporative fuel control system during stop of the engine. Such leak check system includes a factory test mode which is provided with a leak check time that is set shorter than the time required for a normal leak check when the evaporative fuel control system receives a factory test signal.

According to the present invention, the evaporative fuel control system is provided with the leak check system which examines leakage in the evaporative fuel control system by causing negative pressure in the evaporative fuel control system during stop of the engine. This leak check system includes the factory test mode which is provided with a leak check time that is less than the leak check time for a normal leak check when the evaporative fuel control system receives the factory test signal. Accordingly, in checking the completed cars in the factory, evaporative fuel leakage is tested without reduction in assembly line speed, and thus does not create a problem of exceeding the process time allowed for the assembly line.

DETAILED DESCRIPTION OF THE INVENTION

The evaporative fuel control system of the present invention includes the factory test mode which is provided with a leak check time that is set less than the leak check time for a normal leak check when the evaporative fuel control system receives the factory test signal. Accordingly, in checking the completed cars in the factory, leakage is tested without reduction in assembly line speed, and without creating a problem of exceeding the process time allowed for the assembly line.

Figure 5:
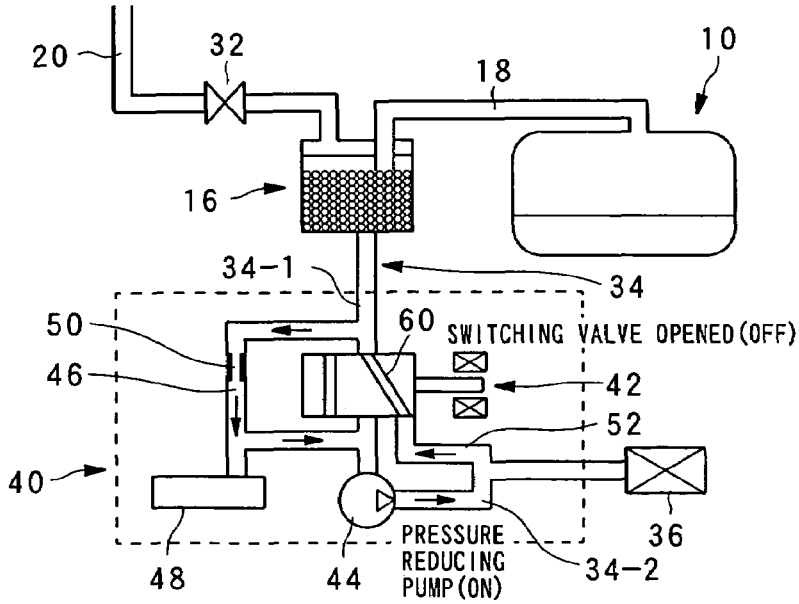
FIG. 5 is a diagram of evaporative fuel control system.
Figure 6:
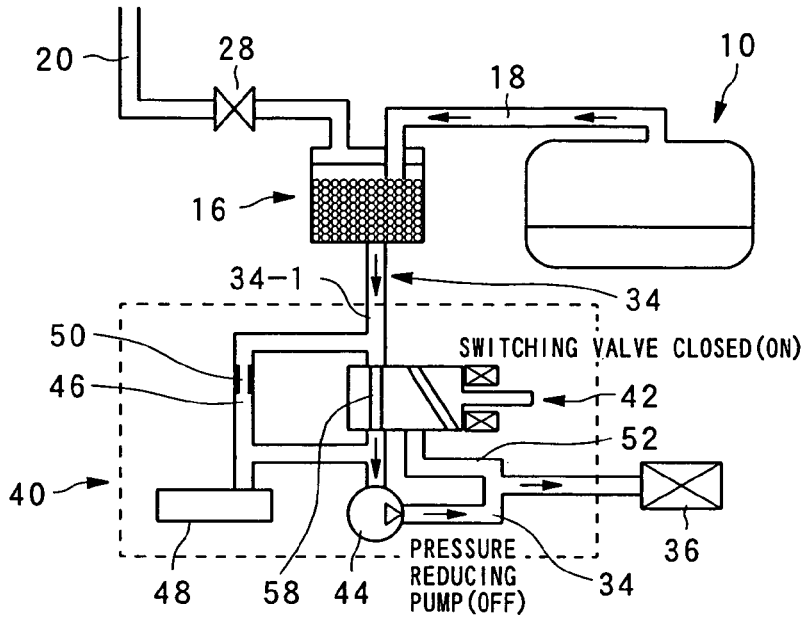
FIG. 6 depicts an operation of elements for measuring reference pressure in the leak check system.
Figure 7:
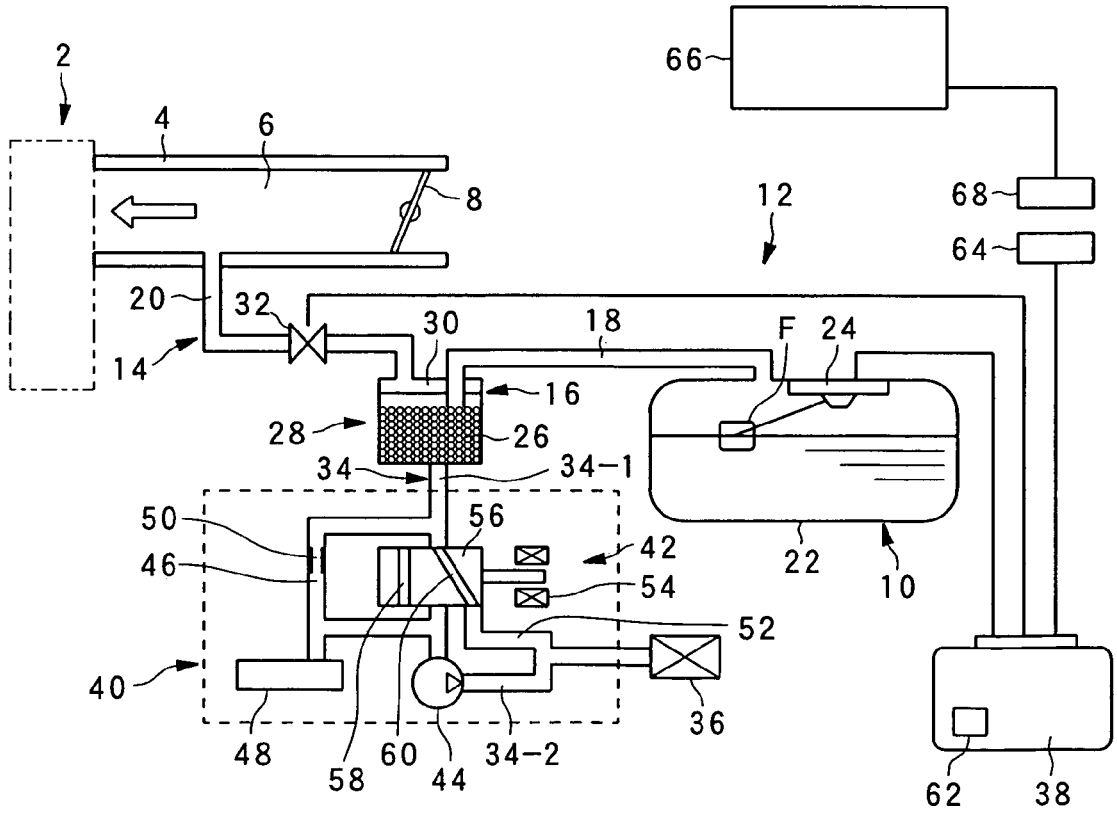
FIG. 7 depicts an operation of elements during vacuuming of the leak check system.

Embodiments of the present invention will now be described in detail with reference to the drawings. FIGS. 1–7 illustrate an embodiment of the present invention. FIG. 7 shows an internal combustion engine 2 mounted on a vehicle (not shown), an intake pipe 4 of the engine 2, an intake passage 6 defined by the intake pipe 4, a throttle valve 8 disposed in the intake passage 6, a fuel tank 10 to store fuel, and an evaporative fuel control system (evaporative system) 12.

In the evaporative fuel control system 12, an evaporative fuel control passage 14 connects an upper part of the fuel tank 10 with the intake passage 6 on a downstream side of the throttle valve 8. On the evaporative fuel control passage 14, a canister 16 is disposed to absorb the evaporative fuel generated in the fuel tank 10. The evaporative fuel control passage 14 is formed by an evaporative passage 18 connecting the fuel tank 10 with the canister 16, and a purge passage 20 connecting the canister 16 with the intake passage 6.

In a boxy tank body 22, the fuel tank 10 includes a fuel level sensor 24 to detect the quantity of fuel in the fuel tank 10. This fuel level sensor 24 outputs electric signals based on the height of a float F which moves upwardly or downwardly in accordance with the fuel quantity.

The canister 16 contains an activated carbon 28 in a boxy canister body 26 to absorb the evaporative fuel, and connects, at a top section thereof, the evaporative passage 18 with the purge passage 20. The evaporative passage 18 is directly connected to the activated carbon 28, and the purge passage 20 is connected to an upper space 30 defined in the canister body 26.

On the purge passage 20, a purge valve 32 is disposed to control the quantity of the evaporative fuel (purge quantity) that is purged by the canister 16 and supplied to the intake passage 6. Duty ratio of this purge valve 32 is controlled to be between 0–100%. That is, the purge valve 32 is closed at duty ratio 0% to fully shut the purge passage 20, and is opened at duty ratio 100% to fully open the purge passage 20. Opening degree of the purge passage 20 can be changed between duty ratio 0–100% for a purge control of the evaporative fuel absorbed in the canister 16 to supply to the intake passage 6.

On a lower part of the canister 16, an atmosphere open passage 34 is connected at a base end thereof to open the canister 16 to the atmosphere. On this atmosphere open passage 34, a switching valve 42 as an atmosphere open/close valve (canister air valve) is disposed to connect/disconnect the air. The atmosphere open passage 34 has at one end thereof an air filter 36 to remove dust introduced from outside.

A purge controller 38 of the evaporative fuel control system 12 is connected to the fuel level sensor 24, the purge valve 32, and the switching valve 42. The purge controller 38 controls the purge valve 32 and the switching valve 42 such that the evaporative fuel, absorbed in the canister 16, is purged by the atmosphere through the atmosphere open passage 34 and is supplied to the intake passage 6 during normal operation of the engine 2.

The evaporative fuel control system 12 includes a leak check system 40 which examines leakage in the evaporative fuel control system 12 by generating a negative pressure (pressure less than that of the ambient atmosphere) in the evaporative fuel control system 12 during stop of the engine 2.

On the atmosphere open passage 34 in communication with the canister 16, the leak check system 40 includes a switching valve 42 which can communicate/disconnect the atmosphere. The atmosphere open passage 34 is formed by a first open passage 34-1 toward the canister with respect to the switching valve 42, and a second open passage 34-2 toward the air filter 36 with respect to the switching valve 42. On this second open passage 34-2, a pressure reducing pump 44 acting as a pressure reducing means is disposed to vacuum or generate a negative pressure in the evaporative fuel control system 12.

While bypassing the switching valve 42, the atmosphere open passage 34 includes a first bypass passage 46 of which one end is connected to the first open passage 34-1 toward the canister 16 with respect to the switching valve 42, and the other end is connected to the second open passage 34-2 between the switching valve 42 and the pressure reducing pump 44. On the first bypass passage 46, a pressure sensor 48 is disposed toward the second open passage 34-2 as a pressure detector to detect the pressure in the evaporative fuel control system 12. A reference orifice 50 is also disposed toward the first open passage 34-1 as a reference pressure regulator to adjust the pressure applied to the pressure sensor 48 to the reference pressure.

In addition, the atmosphere open passage 34 includes a second bypass passage 52 of which one end is connected to the second open passage 34-2 between the pressure reducing pump 44 and the air filter 36 and other end is connected to the switching valve 42, while bypassing the pressure reducing pump 44.

The switching valve 42 has a solenoid 54 and a valve element 56 that is operated by energizing of the solenoid 54. The valve element 56 includes a straight port 58 and a diagonal port 60. As shown in FIG. 5, when the solenoid 54 is not energized (deactivated), the switching valve 42 shuts the atmosphere open passage 34 and the diagonal port 60 is positioned to communicate the first open passage 34-1 with the second bypass passage 52. Also as shown in FIG. 6, the switching valve 42 communicates the atmosphere open passage 34 when the solenoid 54 is energized (activated) and the straight port 58 is positioned to communicate the first and second main passages 34-1, 34-2.

The purge controller 38 of the evaporative fuel control system 12 is connected to the pressure reducing pump 44, the pressure sensor 48, and the solenoid 54 of the switching valve 42. Also, the purge controller 38 includes a leak determination means 62 to determine whether there is a leakage in the evaporative fuel control system 12.

Thus, the leak check system 40 includes, on the atmosphere open passage 34, the switching valve 42 to communicate/disconnect to the atmosphere, the pressure reducing pump 44 to vacuum or generate a negative pressure inside of the evaporative fuel control system 12, the pressure sensor 48 as a pressure detecting means to detect the pressure within the evaporative fuel control system 12, the reference orifice 50 as a reference pressure regulator to adjust the pressure applied to the pressure sensor 48 to the reference pressure, and the leak determination means 62 to determine whether there is leakage in the evaporative fuel control system 12 by using the reference pressure adjusted by the reference orifice 50 and a reduced pressure in which the switching valve 42 is switched to an atmosphere shut side and the pressure reducing pump 44 vacuums the evaporative fuel control system 12 during stop of the engine 2.

The evaporative fuel control system 12 includes a system-side connector 64 through which the factory test signal is input to the purge controller 38. Device-side connector 68 of a testing device 66 is detachably fitted to the system-side connector 64. This testing device 66 outputs the factory test signal to the purge controller 38 when the system-side connector 64 is engaged with the device-side connector 68 in testing of the completed cars in the factories.

The leak check system 40 is provided with a factory test mode in which a leak check time is set to be less than the leak check time for the normal operation of the engine 2 when the evaporative fuel control system 12 receives the factory test signal. The leak check in the factory test mode is performed independently from the operation of the engine 2.

Operation of one embodiment of the present invention is explained as follows.

Figure 3:
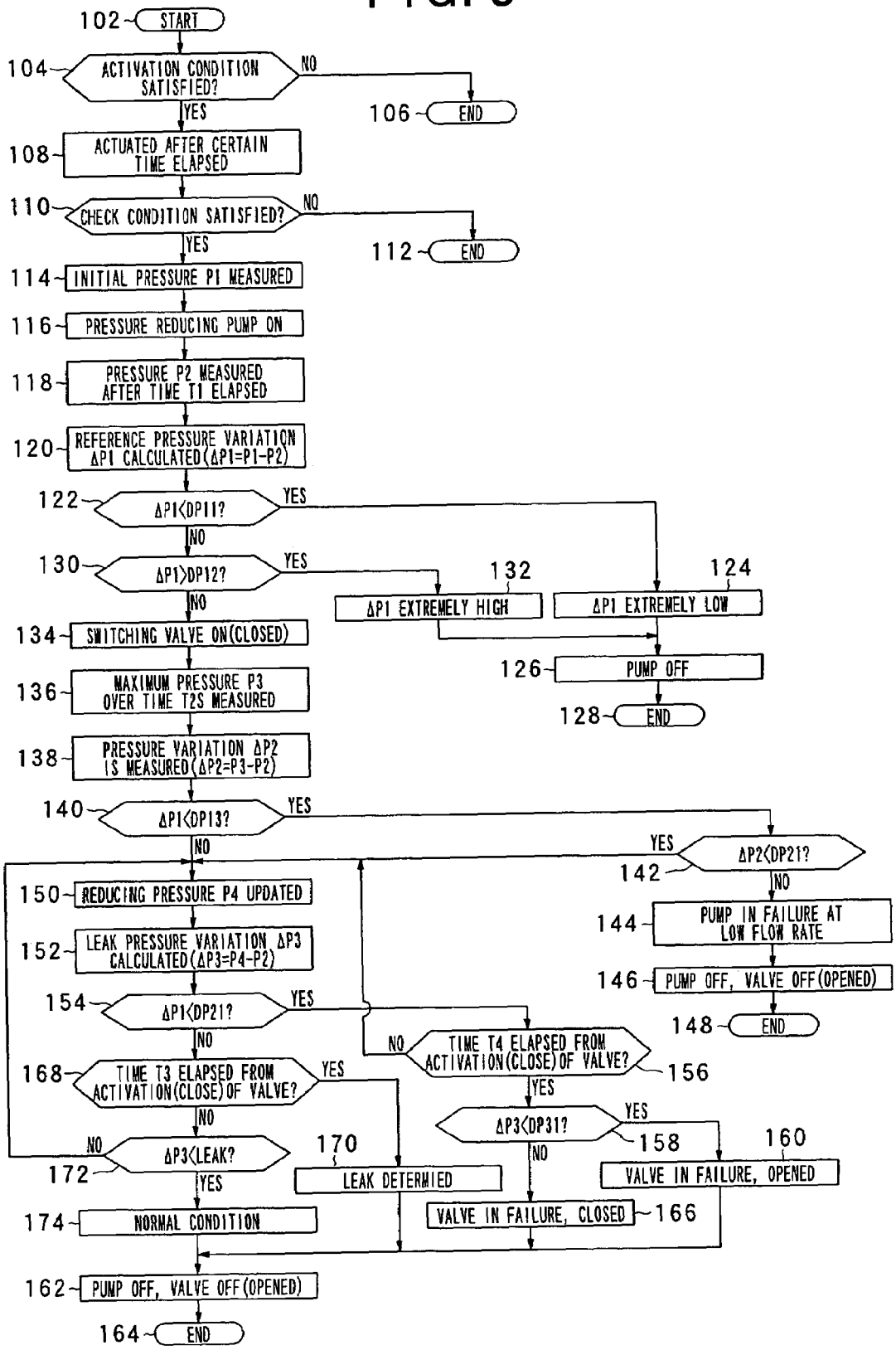
FIG. 3 is a flow chart depicting the steps of a leak-check in a normal condition of the evaporative fuel control system.

Referring to FIG. 3, a program for the leak check of the evaporative fuel control system 12 starts in step 102 during a normal operation of the engine 2 (in fact, during stop of the engine 2 while the vehicle stops). A determination is made in step 104 whether a start condition is satisfied.

If the determination in step 104 is "NO", the program ends in step 106. If the determination in step 104 is "YES", the leak check system 40 is actuated after a certain amount of time has elapsed in step 108. Then a determination is made in step 110 whether a leak check condition is satisfied. At this time, in the leak check system 40, the switching valve 42 is deactivated (opened), and the pressure reducing pump 44 is deactivated.

If the determination in step 110 is "NO", then program ends in step 112. If the determination in step 110 is "YES", then initial pressure P1 in the evaporative fuel control system 12 is measured in step 114. The pressure reducing pump 44 is actuated in step 116. Then a pressure P2 in the evaporative fuel control system 12 is measured in step 118 after a first predetermined amount of time T1 has elapsed since the activation of the pressure reducing pump 44. In step 120, a reference pressure variation P1 is calculated (P1=P1−P2).

As shown in FIG. 5, the atmosphere open passage 34 is suitable to measure the reference pressure when the switching valve 42 is deactivated (open) and the pressure reducing pump 44 is activated. The switching valve 42 shuts the atmosphere open passage 34 and the diagonal port 60 of the switching valve 42 places the first and second bypass passages 46 and 52, respectively, in communication with one another.

In step 122, a determination is made whether the reference pressure variation P1 calculated in step 120 is below DP11 (first reference pressure determination value). If the determination in step 122 is "YES", it is determined that the reference pressure variation P1 is extremely low in step 124, followed by deactivation of the pressure pump 44 in step 126. Then the program ends in step 128.

If the determination in step 122 is "NO", then another determination is made in step 130 whether the reference pressure variation P1 exceeds DP12 (second reference pressure determination value). If this determination in step 130 is "YES", it is determined that the reference pressure variation P1 is extremely high in step 132, then the program goes to step 126.

If this determination in step 130 is "NO", the switching valve 42 is actuated (closed) in step 134. In step 136, maximum pressure P3 in the evaporative fuel control system 12 is measured over a second predetermined amount of time T2 after the activation of the switching valve 42. Then pressure variation P2 at switching of the switching valve is calculated in step 138 (P2=P3−P2). In step 140, a determination is made whether the reference pressure variation P1 is below DP13 (third reference pressure determination value).

As shown in FIG. 6, when the pressure reducing pump 44 is deactivated and the switching valve 42 is actuated (closed), the atmosphere open passage 34 is opened and is under decreased pressure while the straight port 58 of the switching valve 42 places the first and second open passages 34-1 and 34-2, respectively, in communication with one another.

If the determination in step 140 is "YES", another determination is made in step 142 whether the valve switching pressure variation P2 is below DP21 (determination pressure value at switching of valve).

If the determination in step 142 is "NO", then it is determined in step 144 that the pressure reducing pump 44 is in failure at a low flow rate. The pressure reducing pump 44 is deactivated and the switching valve 42 is deactivated (opened) in step 146, and the program ends in step 148.

If the determination in step 140 is "NO" or the determination in step 142 is "YES", then a reducing pressure P4 in the evaporative fuel control system 12 is updated in step 150. Then a leak determination pressure variation P3 is calculated in step 152 (P3=P4−P2). In step 154, a determination is made whether the valve switching pressure variation P2 is below DP21 (determination pressure value at switching of valve).

If the determination in step 154 is "YES", then another determination is made in step 156 whether a fourth predetermined time T4 has elapsed from activation (close) of the switching valve 42. If the determination in step 156 is "NO", the program returns to step 150 to update the reducing pressure P4 in the evaporative fuel control system 12.

If the determination in step 156 is "YES", then a further determination is made in step 158 whether leak determination pressure variation P3 is below DP31 (pressure determination value).

If the determination in step 158 is "YES", then it is determined in step 160 that the switching valve 42 is in failure, remaining opened. The pressure reducing pump 44 is deactivated and the switching valve 42 is deactivated (opened) in step 162, and the program ends in step 164. If the determination in step 158 is "NO", then it is determined in step 166 that the switching valve 42 is in failure, remaining closed. The pressure reducing pump 44 is deactivated and the switching valve 42 is deactivated (opened) in step 162, and the program ends in step 164.

If the determination in step 154 is "NO", then another determination is made in step 168 whether a third predetermined time T3 has elapsed from activation (close) of the switching valve 42. If the determination in step 168 is "YES", then it is determined in step 170 that the evaporative fuel control system 12 is in failure for leak, and the program goes to step 162. If the determination in step 168 is "NO", then a further determination is made in step 172 whether the leak determination pressure variation P3 is below LEAK (leak determination value).

If the determination in step 172 is "NO", the program returns to step 150 to update the reducing pressure P4 in the evaporative fuel control system 12. If the determination in step 172 is "YES", it is determined in step 174 that the evaporative fuel control system 12 is in a normal condition. The pressure reducing pump 44 is deactivated and the switching valve 42 is deactivated (opened) in step 162, and the program ends in step 164.

Leak check during normal operation of the engine 2 is next explained with reference to a time chart of FIG. 4.

Figure 4:
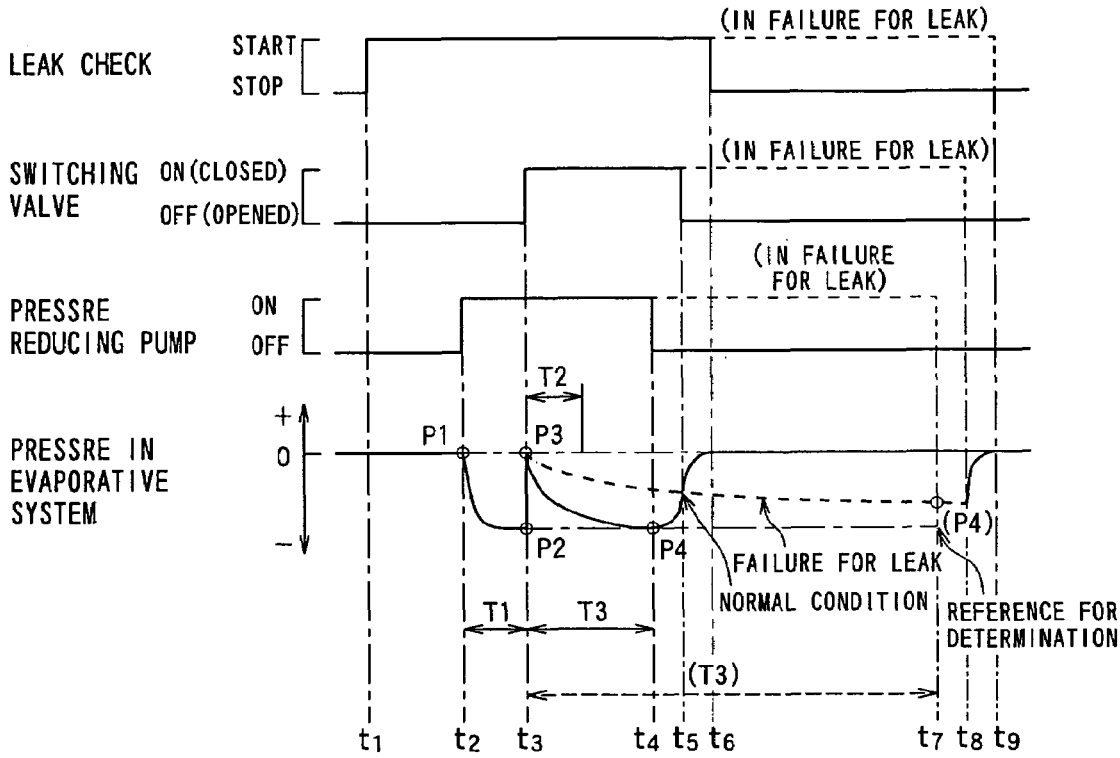
FIG. 4 is a time chart for a leak-check conducted in a normal condition of the evaporative fuel control system.

As shown in FIG. 4, the leak check starts at time t1. After the pressure reducing pump 44 is switched from a deactivate state to an actuation state at time t2, the pressure in the evaporative fuel control system 12 drops toward the negative pressure side (−) from pressure P1 (substantially zero) until the pressure in the evaporative fuel control system 12 reaches the reference pressure or pressure P2.

After the first predetermined time T1 has elapsed from the activation of the pressure reducing pump 44 (from time t2), the switching valve 42 is switched for actuation (close) at time t3. Over the first predetermined time T1 between time t2 and time t3, the reference pressure in the evaporative fuel control system 12 has been measured.

After time t3 at which the switching valve 42 is activated (closed), the negative pressure in the evaporative fuel control system 12 rapidly increases toward a positive pressure (+) reaching the pressure P3 (substantially zero). The pressure P3 is a maximum pressure over a second predetermined time T2 after the activation (close) of the switching valve 42.

While the switching valve 42 is activated (closed) at time t3 and remains actuated (closed), the pressure in the evaporative fuel control system 12 begins to drop toward a negative pressure (+).

If the evaporative fuel control system 12 is in a normal condition (without leak, shown by a solid line), the pressure in the evaporative fuel control system 12 suddenly begins to drop toward a negative pressure (−). At time t4, the pressure reducing pump 44 is deactivated when the pressure in the evaporative fuel control system 12 reaches the determination reference pressure, or pressure P4. The third predetermined time T3 between time t3 and time t4 is a pressure reducing time for the evaporative fuel control system in the normal condition.

After time T3 has elapsed and after time t5 at which the switching valve 32 is deactivated, the pressure in the evaporative fuel control system 12 increases toward a positive pressure (+). Then the leak check is stopped at time t6 and the pressure in the evaporative fuel control system 12 is maintained at zero.

In contrast, in the event the evaporative fuel control system is failing (leaking) while actuation of the switching valve 42 is maintained after time t3, the pressure in the evaporative fuel control system 12 remains closer to zero as compared to that of normal condition, which is associated with a relatively lower negative pressure as shown by a dashed-line. Even at time t4 at which the third predetermined time T3 has elapsed, the pressure in the evaporative fuel control system 12 does not reach the determination reference pressure.

As a result, in the event the evaporative fuel control system is failing (leaking), the pressure reducing pump 44 is deactivated at time t7 with long delay as compared to the normal condition. The third predetermined time T3 is extended as shown in dashed lines. After time t8 when the switching valve 32 is deactivated (closed), the pressure in the evaporative fuel control system 12 increases toward a positive pressure (+). Then the leak check is stopped at time t9 and the pressure in the evaporative fuel control system 12 is maintained at zero.

As thus described, the leak check system 40 includes, on the atmosphere open passage 34, the switching valve 42 to communicate/disconnect to the atmosphere, the pressure reducing pump 44 to vacuum or generate negative pressure inside of the evaporative fuel control system 12, the pressure sensor 48 as a pressure detecting means to detect the pressure within the evaporative fuel control system 12, the reference orifice 50 as a reference pressure regulator to adjust the pressure applied to the pressure sensor 48 to the reference pressure, and the leak determination means 62 to determine whether there is a leakage in the evaporative fuel control system 12 by using the reference pressure adjusted by the reference orifice 50 and a reduced pressure in which the switching valve 42 is switched to an atmosphere shut side and the pressure reducing pump 44 vacuums the evaporative fuel control system 12 during stop of the engine 2.

The evaporative fuel control system 12 executes the leak check after reducing the pressure in the check passage in the evaporative fuel control system 12 by the pressure reducing pump 44, thereby providing a leak check result with high accuracy.

Figure 1:
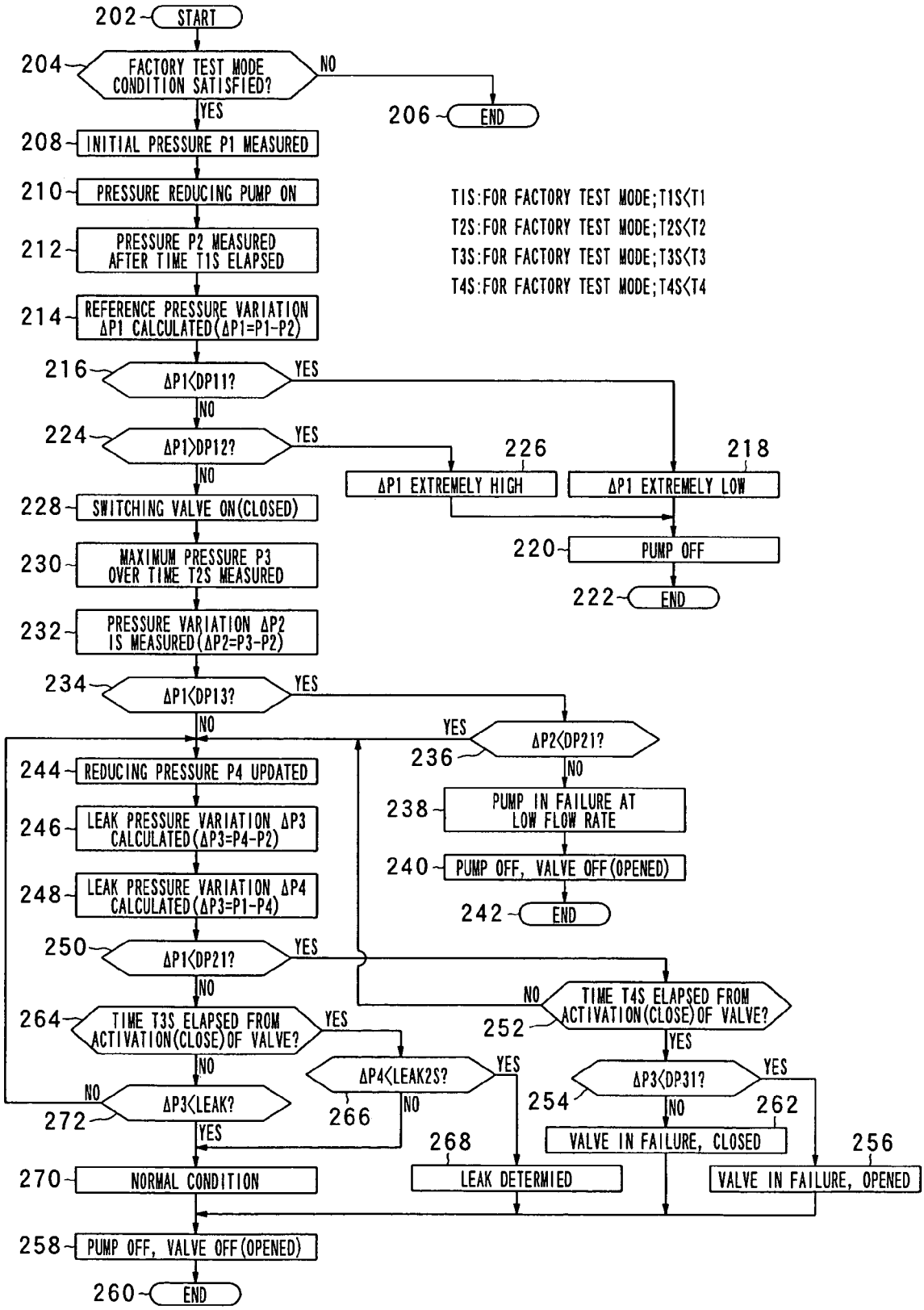
FIG. 1 is a flow chart depicting the steps of a leak check for an evaporative fuel control system in a factory test mode according to an embodiment of the present invention.

Next, the leak check for the factory test mode is explained with reference to a flowchart of FIG. 1.

Figure 2:
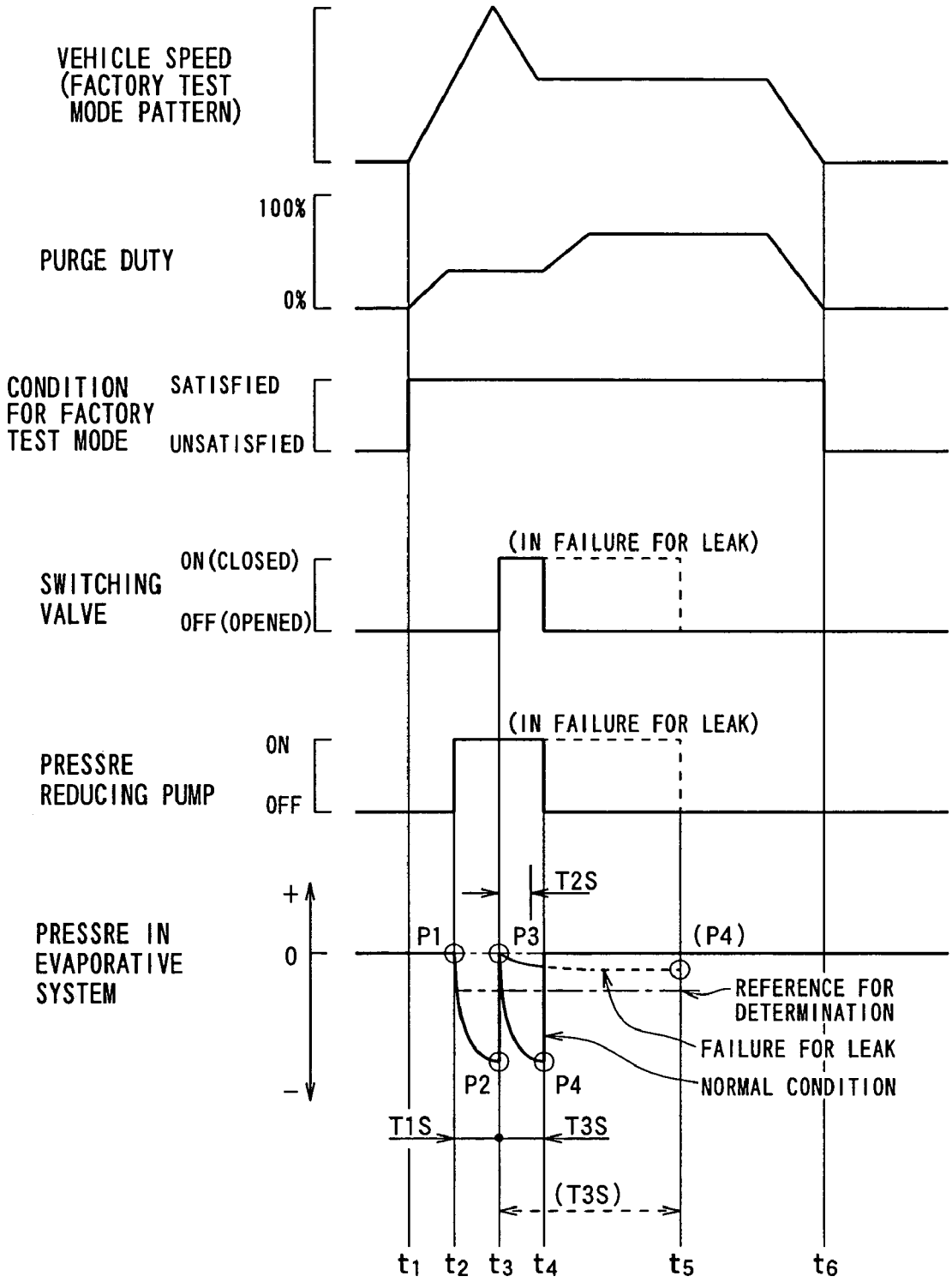
FIG. 2 is a time chart for a leak-check conducted in the factory test mode.

The factory test mode is configured to have predetermined times for test modes T1S, T2S, T3S, T4S which are shorter in duration than predetermined times for normal modes T1, T2, T3, T4, respectively (T1S<T1, T2S<T2, T3S<T3, T4S<T4). In this factory test mode, the determination reference pressure is changed with respect to that for normal mode. Also, the leak check for the factory test mode is performed during running of the vehicle or purging, as shown in FIG. 2.

For the factory test mode, a program for the leak check of the evaporative fuel control system 12 starts in step 202 during the process of checking the completed cars in the factories. A determination is made in step 204 whether a factory test mode condition is satisfied. This factory test mode condition is satisfied if the purge controller 38 receives the factory test mode signal which is output when the system-side connector 64 is engaged with the device-side connector 68, as shown in FIG. 7. At this time, in the leak check system 40, the switching valve 42 is deactivated (opened), and the pressure reducing pump 44 is deactivated.

If the determination in step 204 is "NO", then the program ends in step 206. If the determination in step 204 is "YES", then initial pressure P1 in the evaporative fuel control system 12 is measured in step 208. The pressure reducing pump 44 is actuated in step 210. Then a pressure P2 in the evaporative fuel control system 12 is measured in step 212 after a first predetermined time TIS has elapsed since activation of the pressure reducing pump 44. In step 214, a reference pressure variation P1 is calculated (P1=P1−P2).

As shown in FIG. 5, the atmosphere open passage 34 is suitable for measuring the reference pressure when the switching valve 42 is deactivated (open) and the pressure reducing pump 44 is activated. The switching valve 42 shuts the atmosphere open passage 34 and the diagonal port 60 of the switching valve 42 communicates the first bypass passage 46 with the second bypass passages 52.

In step 216, a determination is made as to whether the reference pressure variation P1 calculated in step 214 is below DP11 (first reference pressure determination value). If the determination in step 216 is "YES", it is determined that the reference pressure variation P1 is extremely low in step 218, followed by deactivation of the pressure pump 44 in step 220. Then the program ends in step 222.

If the determination in step 216 is "NO", then another determination is made in step 224 whether the reference pressure variation P1 exceeds DP12 (second reference pressure determination value). If this determination in step 224 is "YES", it is determined that the reference pressure variation P1 is extremely high in step 226, then the program goes to step 220.

If this determination in step 224 is "NO", the switching valve 42 is actuated (closed) in step 228. In step 230, a maximum pressure P3 in the evaporative fuel control system 12 is measured over a second predetermined time T2S after the activation of the switching valve 42. Then pressure variation P2 at switching of the switching valve is calculated in step 232 (P2=P3−P2). In step 234, a determination is made whether the reference pressure variation P1 is below DP13 (third reference pressure determination value).

As shown in FIG. 6, when the pressure reducing pump 44 is deactivated and the switching valve 42 is actuated (closed), the atmosphere open passage 34 is opened and is under decreased pressure while the straight port 58 of the switching valve 42 communicates the first open passage 34-1 with the second open passage 34-2.

If the determination in step 234 is "YES", another determination is made in step 236 whether the valve switching pressure variation P2 is below DP21 (determination pressure value at switching of valve).

If the determination in step 236 is "NO", then it is determined in step 238 that the pressure reducing pump 44 is failing at a low flow rate. The pressure reducing pump 44 is deactivated and the switching valve 42 is deactivated (opened) in step 240, and the program ends in step 242.

If the determination in step 234 is "NO" or the determination in step 236 is "YES", a reducing pressure P4 in the evaporative fuel control system 12 is updated in step 244. Then a leak determination pressure variation P3 is measured in step 246 (P3=P4−P2). Also, a leak determination pressure variation P4 is measured in step 248 (P4=P1−P4). In step 250, a determination is made whether the valve switching pressure variation P2 is below DP21 (switching valve pressure determination value).

If the determination in step 250 is "YES", then another determination is made in step 252 whether a fourth predetermined time T4S has elapsed from activation (close) of the switching valve 42. If the determination in step 252 is "NO", the program returns to step 244 to update the reducing pressure P4 in the evaporative fuel control system 12.

If the determination in step 252 is "YES", then a further determination is made in step 254 as to whether leak determination pressure variation P3 is below DP31 (pressure determination value).

If the determination in step 254 is "YES", then it is determined in step 256 that the switching valve 42 has failed, remaining opened. The pressure reducing pump 44 is deactivated and the switching valve 42 is deactivated (opened) in step 258, and the program ends in step 260. If the determination in step 254 is "NO", then it is determined in step 262 that the switching valve 42 has failed, remaining closed. Then the program goes to process in step 258.

If the determination in step 250 is "NO", then another determination is made in step 264 whether a third predetermined time T3S has elapsed from activation (closing) of the switching valve 42. If the determination in step 264 is "YES", then a further determination is made in step 266 whether the leak determination pressure variation P4 is below LEAK2S (second leak determination value).

If the determination in step 266 is "YES", then it is determined in step 268 that the evaporative fuel control system 12 is in failure for leak, and the program goes to step 258. If the determination in step 266 is "NO", it is determined in step 270 that the evaporative fuel control system 12 is in a normal condition, and the program goes to step 258.

If the determination in step 264 is "NO", then a further determination is made in step 272 whether the leak determination pressure variation P3 is below LEAK (leak determination value). If the determination in step 272 is "NO", the program returns to step 244 to update the reducing pressure P4 in the evaporative fuel control system 12. If the determination in step 272 is "YES", it is determined in step 270 that the evaporative fuel control system 12 is in a normal condition. The pressure reducing pump 44 is deactivated and the switching valve 42 is deactivated (opened) in step 258, and the program ends in step 260.

Next, the leak check for the factory test mode is explained with reference to a time chart of FIG. 2.

As shown in FIG. 2, the vehicle speed and the purge duty ratio increase from zero, and the factory test mode condition is satisfied at time t1. At time t2 when the pressure reducing pump 44 is actuated, the pressure in the evaporative fuel control system 12 decreases toward a the negative pressure (−) from pressure P1 (substantially zero) until the pressure in the evaporative fuel control system 12 reaches pressure P2 beyond the reference pressure.

After the first predetermined time T1S has elapsed from the activation of the pressure reducing pump 44 (from time t2), the switching valve 42 is actuated (closed) at time t3. Over the first predetermined time T1S between time t2 and time t3, the reference pressure in the evaporative fuel control system 12 has been measured.

After time t3 at which the switching valve 42 is activated (closed), the (negative) pressure in the evaporative fuel control system 12 rapidly increases toward a more positive pressure, reaching the pressure P3 (substantially zero). The pressure P3 is a maximum pressure over a second predetermined time T2S after the activation (close) of the switching valve 42.

While the switching valve 42 is activated (closed) at time t3 and remains actuated (closed), the pressure in the evaporative fuel control system 12 begins to decrease, or move toward a more negative pressure, from the pressure P3.

If the evaporative fuel control system 12 is in a normal condition (without a leak, shown by a solid line), the pressure in the evaporative fuel control system 12 suddenly decreases or drops toward a more negative pressure. At time t4, the pressure reducing pump 44 is deactivated when the pressure in the evaporative fuel control system 12 reaches the pressure P4 beyond the determination reference pressure. The third predetermined time T3S between time t3 and time t4 is a pressure reducing time for the evaporative fuel control system in the normal condition.

After the third predetermined time T3S has elapsed and after time t4 at which the pressure reducing pump 44 is deactivated, switching valve 32 is deactivated (opened) simultaneously. Consequently, the pressure in the evaporative fuel control system 12 rapidly builds up toward a positive pressure, and is maintained at zero. At time t6, the leak check ends.

In the event the evaporative fuel control system 12 is in failure for leakage while the switching valve 42 is actuated (closed) at time t3, the pressure in the evaporative fuel control system 12 remains closer to zero, as shown by the dashed line, compared to that in a normal condition. Even at time t4 when the third predetermined time T3S has elapsed, the pressure in the evaporative fuel control system 12 does not reach the determination reference pressure.

Accordingly, in the event the evaporative fuel control system 12 is in failure for leakage, the pressure reducing pump 44 is deactivated at time t5 with a delay as compared to the normal condition, which results in extension of the third predetermined time (T3S) as shown by the dashed-line. At time t5 when the switching valve 32 is deactivated (closed), the pressure in the evaporative fuel control system 12 is maintained at zero and thus is now closer to being a positive pressure (+) is maintained at zero. At time t6, the leak check ends.

The evaporative fuel control system 12 reduces the amount of time required to check the completed cars in the factories, while maintaining the precision required in the assembly process as well as reducing costs. The testing device 66 and the purge controller 38, which are placed at a side of the factory lines, are connected through communication cables, so that the testing device 66 issues an order to change to the factory test mode for the leak check of the completed cars by the leak detecting means 62 of the leak check system 40.

The factory test mode includes additional or changed control with respect to the normal mode as described below. (1) The leak check starts even during running of the vehicle on the check lines, and is not interrupted or stopped by a vehicle speed condition. (2) In order to minimize the vacuum time to check the leak in the evaporative fuel control system 12, the pressure reducing pump 44 and purge from the canister 16 to the intake passage 6 is utilized. (3) Time for each section is reduced as much as possible. (4) For determination of failure, the determination reference pressure is changed from that used in the normal mode, with a comparison being made not to the determination reference pressure but to the atmospheric pressure.

As shown in FIG. 7, the leak check system 40 of the evaporative fuel control system 12 has the switching valve 42, the pressure reducing pump 44, the pressure sensor 48, and the reference orifice 50 integrated thereinto as an integral leak check module, although it is possible that these elements are not integrated. The modularized leak check system 40 is positioned toward an air-side with respect to the canister 16.

If the leak check starts when the leak check condition is satisfied during operation of the vehicle (in fact during stop of the engine while the vehicle is stopped), the pressure pump 44 is actuated while the switching valve 42 is opened and the reference pressure P2 is measured after a certain time has elapsed. Then while the pressure pump 44 remains actuated, the switching valve 42 is switched to an opened state from a closed state, and the entire evaporative fuel control system 12 is vacuumed or subject to a negative pressure. If the reducing pressure is below P2, then leakage below the reference is determined, and if the reducing pressure is not below P2 after a certain time, then the leakage over the reference is determined. The pressure reducing pump 44 is deactivated and the switching valve 42 is deactivated to finish the leak check.

In contrast to this normal operation, the factory test mode for the completed cars includes the shortened predetermined times T1S, T2S, T3S, T4S, and includes the changed reference pressure for determination of failure. The leak check is performed even during running of the vehicle, and the purge from the canister 16 is utilized to reduce pressure.

As thus described, the leak check system 40 includes the factory test mode which is provided with the leak check time set to a lower amount than that for ordinary operation of the engine 2 when the evaporative fuel control system 12 receives the factory test signal.

Accordingly, in checking the completed cars in the factory, the leakage is tested without reduction in assembly line speed. This in turn reduces the chance that the process time may exceed the allowed time for the assembly line.

In addition, the leak check in the factory test mode is performed independently from the operation of the engine 2, which is an easier condition in which to perform the leak check for the completed cars. This subsequently maximizes the chance that the leak check is conducted and quickly finished.

The evaporative fuel control system of the present invention includes the factory test mode which is provided with a decreased leak check time than that of a normal leak check when the evaporative fuel control system receives the factory test signal. Accordingly, in checking the completed cars in the factory, the leakage is tested without reduction in assembly line speed, or increase in processing time beyond that allowed for the assembly line.

What is claimed is:

1. An evaporative fuel control system for an internal combustion engine, comprising:

a canister for absorbing evaporative fuel generated in a fuel tank, said canister being disposed on an evaporative fuel control passage that connects to an intake passage for the engine and the fuel tank;

an atmosphere open passage which connects the canister with the atmosphere;

a purge valve disposed between the intake passage for the engine and the canister;

a purge controller configured to selectively control the purge valve so that the absorbed evaporative fuel is purged by the canister and supplied to the intake passage for the engine; and a leak check system for examining leakage in the evaporative fuel control system by generating negative pressure in the evaporative fuel control system when the engine is stopped;

wherein said leak check system operates in a factory test mode when the evaporative fuel control system receives a factory test signal, said factory test mode having a leak check time that is shorter in duration than a leak check time for a normal leak check.

2. The evaporative fuel control system for the internal combustion engine according to claim 1, wherein the leak check conducted in the factory test mode can be performed independently from an operation of the engine.

3. The evaporative fuel control system for the internal combustion engine according to claim 1, wherein the leak check system includes, on the atmosphere open passage:

a switching valve to selectively communicate/disconnect the leak check system to the atmosphere;

a pressure reducing means to generate a negative pressure inside of the evaporative fuel control system;

a pressure detector to detect a pressure within the evaporative fuel control system;

a reference pressure regulator to adjust the pressure applied to the pressure detector to the reference pressure; and a leak determination means to determine whether there is a leakage in the evaporative fuel control system by using the reference pressure adjusted by the reference pressure regulator and a reduced pressure in which the switching valve disconnects the leak check system from the atmosphere and the pressure reducing means generates a negative pressure within the evaporative fuel control system during stop of the engine.

* * * * *